United States Patent [19]

Davis

[11] 4,111,791

[45] Sep. 5, 1978

[54] PRODUCTION OF HIGHLY AROMATIC EXTRACT OIL

[75] Inventor: Edgar D. Davis, Borger, Tex.

[73] Assignee: Phillips Petroleum Company, Bartlesville, Okla.

[21] Appl. No.: 771,712

[22] Filed: Feb. 24, 1977

[51] Int. Cl.[2] ..... C10G 37/02

[52] U.S. Cl. ..... 208/78; 208/96

[58] Field of Search ..... 208/78

[56] References Cited

U.S. PATENT DOCUMENTS

| | | | |
|---|---|---|---|
| 3,190,828 | 6/1965 | Daniel et al. | 208/78 |
| 3,303,123 | 2/1967 | Payton et al. | 208/76 |
| 3,591,485 | 7/1971 | Mason | 208/78 |
| 3,928,173 | 12/1975 | James | 208/78 |

*Primary Examiner*—Herbert Levine

[57] ABSTRACT

In a system wherein a topped crude catalytic cracking system and a gas oil catalytic cracking system are operated, and the heavy cycle oils from each system are combined and the combined heavy cycle oil stream is solvent extracted to provide an aromatic extract suitable as feed for a carbon black operation, the aromaticity of the extract is increased by passing a substantial portion of the topped crude heavy cycle oil to the gas oil fractionator and recovering a heavy cycle oil from the gas oil fractionator as charge to solvent extraction.

9 Claims, 1 Drawing Figure

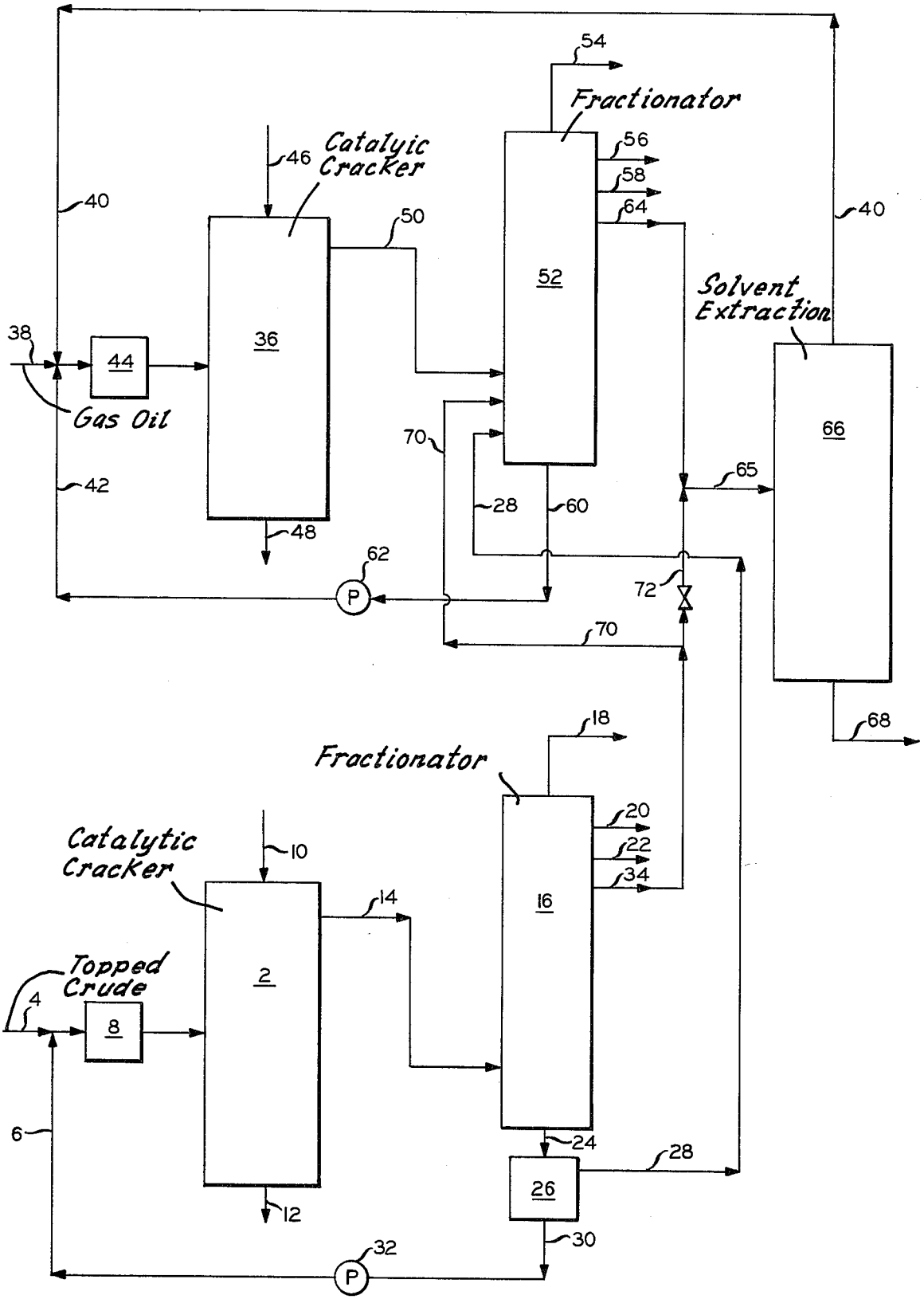
Fractionator
Catalytic Cracker
Solvent Extraction
Gas Oil
Fractionator
Catalytic Cracker
Topped Crude
54
56
58
64
46
50
40
40
52
36
38
44
66
70
65
42
28
60
48
62
P
72
70
68
18
20
22
34
10
14
16
2
4
8
6
24
28
26
12
30
32
P

PRODUCTION OF HIGHLY AROMATIC EXTRACT OIL

This invention relates to hydrocarbon processing. In one aspect, this invention relates to the production of a solvent extracted heavy cycle oil having increased aromaticity.

The conversion of oils is well known. Also, the specific conditions for converting gas oils and topped crude oils of various kinds are well established in the art. Also known are certain combinations of operations, each of which is designed to produce certain advantages of operation, yield, or product quality, or a combination of one or more of these related objects.

It is known to employ two or more catalytic cracking zones wherein feedstocks containing differing concentrations of catalyst-contaminating metals are separately cracked. It is also known to fractionally distill the effluents from each cracking zone into light hydrocarbons, gasoline, light cycle oil and heavy cycle oil; to combine the heavy cycle oils from each fractional distillation and to solvent extract the combined heavy cycle oils to provide an aromatic extract which is valuable as a carbon black process feedstock.

It is also known that the structure of carbon black produced from an aromatic extract oil is related to the aromaticity of the extract oil. It is therefore desireable to employ a carbon black process feedstock having a high aromaticity.

It has been proposed, in a process employing at least two catalytic cracking zones, to pass the heavy cycle oil obtained by cracking topped crude oil to the gas oil cracking zone, rather than directly to the solvent extraction zone. While the extract oil obtained from such operation has a higher aromaticity, the volume of gas oil processed is undesireably reduced by the volume of the heavy cycle oil from the topped crude thus processed.

It has now been found that the aromaticity of the extract oil can be increased without reducing the amount of gas oil processed by passing a substantial portion of the heavy cycle oil obtained by cracking topped crude to the gas oil cracked products fractionation zone.

Accordingly, an object of the present invention is to provide a process for increasing the aromaticity of the extract oil with maximum feed to the gas oil catalytic cracker.

Other objects and advantages will be apparent to those skilled in the art upon study of this disclosure including the detailed description of the invention and the appended drawing which is a diagrammatic flow plan of a preferred embodiment of the invention.

In accordance with the present invention I have discovered that the aromaticity of a solvent extract oil can be increased without reducing the volume of gas oil cracked in a catalytic cracking zone by passing a substantial portion of the heavy cycle oil obtained by cracking topped crude to the gas oil cracked products fractionation zone.

More specifically, the process of this invention comprises the steps of:

(a) passing a topped crude stream to a first catalytic cracking zone wherein said stream is subjected to catalytic cracking;

(b) passing the effluent obtained in step (a) to a first fractionation zone wherein the cracked products are separated into separate distillate fractions comprising light hydrocarbons, gasoline, light cycle oil, heavy cycle oil and a catalyst-containing bottoms product;

(c) passing a substantial portion of the heavy cycle oil obtained in step (b) to a second fractionation zone;

(d) passing a gas oil stream to a second catalytic cracking zone wherein said gas oil stream is subjected to catalytic cracking;

(e) passing the effluent obtained in step (d) to said second fractionation zone wherein the cracked products and the heavy cycle oil from step (b) are separated into separate distillate fractions comprising light hydrocarbons, gasoline, light cycle oil, heavy cycle oil and a catalyst-containing bottoms product; and (f) passing said heavy cycle oil obtained in step (e) to a solvent extraction zone wherein the oil is separated into an aromatics-containing extract phase and into a paraffin-containing raffinate phase.

Referring now to the drawing, a hydrocarbon feed stream comprising topped crude, pitch, residual oils, or other hydrocarbon fluids containing relatively large amounts of metal contaminants or coke and gas forming components is passed to catalytic cracking zone 2 by way of line 4. A recycle stream, as later described, can be introduced by way of line 6, and together with the fresh feed in line 4, makes up the total feed to cracking zone 2. Heat is provided to the feed stream by means of heater 8. Hot regenerated catalyst and make-up catalyst for catalytic cracking zone 2 are introduced by way of line 10 and used catalyst is removed and passed to a regeneration zone (not shown) by way of line 12, or discarded if desired. Reaction effluent from catalytic cracking zone 2 is passed by way of line 14 to product fractionation zone 16. $C_4$ and lighter hydrocarbons are removed from zone 16 by way of line 18, a gasoline fraction is removed by way of line 20 and a light cycle oil is removed by way of line 22. The bottoms product from zone 16 is withdrawn through line 24 and passed to external decanter 26 (e.g., Dorr thickener). The decant oil is removed by way of line 28. The slurry oil is removed by way of line 30, passed through pump 32 and recycled to cracking unit 2 by way of line 6. A heavy cycle oil is removed from the fractionation zone 16 through line 34.

A second hydrocarbon feed stream is fed to catalytic cracking zone 36 by way of line 38. The feed stream introduced by way of line 38 is made up of gas oil and other distillates so that the metal content of the feed stream is quite small. The recycle streams which can be introduced by way of lines 40 and 42 make up the total feed to the catalytic cracking zone 36. Heater 44 heats the fresh feed and recycle streams to a temperature slightly under that at which thermal cracking might occur prior to admission to the cracking zone 36. Hot regenerated catalyst is added to the catalytic cracking zone 36 by way of line 46 and used catalyst is removed by way of line 48 and passed to a regeneration zone (not shown) and is then returned to the catalytic cracking zone 36 at a temperature higher than the catalytic cracking temperature so that the mixture of heated oil and regenerated catalyst achieves the desired cracking temperature in the cracking zone.

The hydrocarbon effluent from the cracking zone 36 is passed by way of line 50 to product fractionation zone 52 wherein the effluent products are separated into fractions having different boiling ranges. $C_4$ and lighter materials are removed by way of line 54, a gasoline cut is removed by way of line 56, and light cycle oil is removed by way of line 58 to form the various products of the process. The total bottoms product including catalyst fines carried over from catalytic cracking unit 36 by way of line 50 is removed from the base of fractionation zone 52 by way of line 60, passed through pump 62 and passed by way of line 42 to the gas oil cracking zone 36 as recycle. Heavy cycle oil is removed by way of line 64 and passed through line 65 to solvent extraction zone 66.

A conventional solvent-extraction process is employed in zone 66 utilizing a suitable solvent, e.g., liquid sulfur dioxide, such as to extract aromatic hydrocarbons. The aromatic compounds are absorbed from the oil so as to produce a paraffinic raffinate which can be returned to the cracking zone 36 by way of line 40. An aromatic-containing extract oil is removed from zone 66 by way of line 68. Such an oil is useful as feed for a carbon black producing process.

In accordance with the present invention, a substantial portion of the heavy cycle oil in line 34 is passed to the second fractionation zone 52 through line 70. If desired, the remaining portion of heavy cycle oil in line 34 can be passed through line 72 and combined with the heavy cycle oil in line 64. The combined stream is passed through line 65 to solvent extraction zone 66. The term "substantial portion" as used herein and in the claims, is intended to mean that amount sufficient to limit the amount of heavy cycle oil in line 72 which is combined with the heavy cycle oil in line 64 to 10 percent or less of the resulting combined feed in line 65 to solvent extraction zone 66.

In a presently preferred embodiment, the amount of heavy cycle oil from line 72 is limited to a maximum of about 7 percent of the total combined feed in line 65 with the remainder of the heavy cycle oil from zone 16 being passed through line 70 to fractionation zone 52.

In a more preferred embodiment, all the heavy cycle oil from fractionation zone 16 is passed through lines 34 and 70 to second fractionation zone 52.

Conventional cracking catalysts such as synthetic or natural clays, bauxite, silica-alumina, brucite, molecular sieve type and the like can be used in the practice of this invention. Conventional reaction conditions of temperature, pressure, space velocity and the like are applicable in the practice of this invention.

Catalytic cracking zones 2 and 36 can be operated at different or substantially the same conversion levels and at different or substantially the same temperature. Ordinarily, each of the zones will be operated at a temperature in the range of 805°–970° F (430°–520° C). The conversion level in each zone can vary from about 30 to 80 percent, preferably about 50 percent for each zone.

The topped crude cracking zone 2 will often be operated at a temperature in the range of 870°–960° F (465°–515° C) and a conversion level of 30–60 percent, whereas the gas oil unit 36 will often be operated at a temperature in the range of 905°–970° F, (485°–520° C) at a conversion level in the range of 50–80 percent.

Operation according to the invention increases the aromaticity of the extract oil. A decrease in the API gravity of the extract oil is also seen when operating according to the invention. Also, when the cracked topped crude heavy cycle oil is passed to the cracked gas oil fractionation zone, the higher boiling portion of the cracked topped crude heavy cycle oil dilutes the cracked gas oil fractionation zone's slurry oil, thereby keeping the catalyst content thereof below about 0.5 pound per gallon, as desired for proper pumping.

The following examples illustrate the invention:

EXAMPLE 1

A topped crude and a virgin gas oil were separately cracked and the cracked products were fractionated to provide a topped crude heavy cycle oil and a gas oil heavy cycle oil. Prior to the present invention, these heavy cycle oils were combined and the combined stream was passed to a sulfur dioxide extraction zone and an aromatic extract was obtained therefrom. The following data represent typical operation prior to the present invention:

Table I

| | Heavy Cycle Oil (HCO) Feed to Solvent Extraction Zone | | | Aromatic Extract | |
|---|---|---|---|---|---|
| | Topped Crude | Gas Oil Mixture | | | |
| Run | HCO, % | HCO, % | BMCI | BMCI | API |
| 1 | 19.2 | 80.8 | — | 99.1 | 8.6 |
| 2 | 20.2 | 79.8 | 62.5 | 98.2 | 9.0 |
| 3 | 18.6 | 81.4 | 57.5 | 98.4 | 8.9 |
| 4 | 19.5 | 80.5 | 61.7 | 99.0 | 8.7 |
| Average 1 – 4 | 19.4 | 80.6 | — | 98.7 | — |

As illustrated by the above data, the total heavy cycle oil obtained from the catalytic cracking of topped crude represents an average of 19.4 percent of the total feed to the solvent extraction zone 66. The BMCI of the mixed feed to zone 58 ranges from 57.5 to 62.5, and the BMCI of the extract has an average value of 98.7.

The BMCI (Bureau of Mines Correlation Index) is a measure of the aromaticity of an oil. The BMCI is determined as follows:

$$\text{BMCI} = \left(\frac{876}{460 + F} + \frac{670}{131.5 + \text{API}} - 4.568\right)100$$

wherein F is the boiling point in ° F at the 50 percent recovery distillation point and "API" is the American Petroleum Institute gravity at 60° F. In a carbon black producing process it is preferred to use liquid feedstocks having a BMCI as high as possible, i.e., at least 80, preferably over 90 and more preferably over 100. It is also preferred that the API gravity should be as low as possible, at least less than 25, preferably less than 10.

EXAMPLE II

A topped crude and a virgin gas oil were separately cracked and the cracked products were fractionated to provide a topped crude heavy oil and a gas oil heavy cycle oil. Prior to the present invention, it was proposed that the topped crude heavy cycle oil be passed to the gas oil catalytic cracking zone, rather than combining it with the gas oil heavy cycle oil, as was done in Example I. Data from these runs are as follows:

Table II

| | Heavy Cycle Oil (HCO) Feed to Solvent Extraction Zone | | | Aromatic Extract | |
|---|---|---|---|---|---|
| | Topped Crude | Gas Oil Mixture | | | |
| Run | HCO, % | HCO, % | BMCI | BMCI | API |
| 5 | 0 | 100 | 63.1 | 101.1 | 8.1 |
| 6 | 0 | 100 | 61.9 | 103.7 | 7.4 |
| 7 | 0 | 100 | 60.6 | 102.1 | 7.9 |
| 8 | 0 | 100 | 54.4 | 103.7 | 7.4 |
| Average 5–8 | 0 | 100 | — | 102.7 | — |

The above data illustrate an increase in the BMCI of the extract to an average value of 102.7. Due to equipment capacity limitations, however, all of the cracked topped crude heavy cycle oil cannot be charged to the gas oil catalytic cracking zone, without decreasing the quantity of fresh gas oil charged thereto.

EXAMPLE III

A topped crude and a virgin gas oil were separately cracked and the cracked products were separately fractionated to provide a topped crude heavy cycle oil. In accordance with the present invention, a substantial portion of the topped crude heavy cycle oil was passed to the gas oil cracked products fractionation zone and the remainder was combined with the gas oil heavy cycle oil. The data are as follows:

Table III

| | Heavy Cycle Oil (HCO) Feed To Solvent Extraction Zone | | | | |
|---|---|---|---|---|---|
| | Topped Crude | Gas Oil Mixture | | Aromatic Extract | |
| Run | HCO, % | HCO, % | BMCI | BMCI | API |
| 9 | 5.9 | 94.1 | 56.1 | 102 | 8.0 |
| 10 | 9.2 | 90.8 | 58.6 | 100.7 | 8.4 |
| 11 | 8.0 | 92.0 | 58.3 | 103.1 | 7.5 |
| 12 | 7.1 | 92.9 | 61.6 | 102.2 | 7.9 |
| 13 | 6.3 | 93.7 | 60.3 | 101.5 | 8.2 |
| 14 | 5.3 | 94.7 | 57.2 | 101.1 | 8.2 |
| Average 9–14 | 7.0 | 93.0 | — | 101.8 | — |

Reasonable variations and modifications, which will be apparent to those skilled in the art, can be made in this invention without departing from the spirit and scope thereof.

What is claimed is:

1. A process comprising (a) passing a topped crude stream to a first catalytic cracking zone wherein said stream is subjected to catalytic cracking to produce an effluent of cracked products;

(b) passing the effluent obtained in step (a) to a first fractionation zone wherein the cracked products from the first catalytic cracking zone are separated into separate distillate fractions comprising light hydrocarbons, gasoline, light cycle oil, heavy cycle oil and a catalyst-containing bottoms product;

(c) passing a substantial portion of said heavy cycle oil obtained in step (b) to a second fractionation zone;

(d) passing a gas oil stream to a second catalytic cracking zone wherein said gas oil stream is subjected to catalytic crackign to produce an efflent of cracked products;

(e) passing the effluent obtained in step (d) to said second fractionation zone wherein the cracked products from the second catalytic cracking and the heavy cycle oil from step (b) are separated into separate distillate fractions comprising light hydrocarbons, gasoline, light cycle oil, heavy cycle oil and a catalyst-containing bottoms product; and (f) passing said heavy cycle oil obtained in step (e) to a solvent extraction zone wherein the oil is separated into an aromatics-containing extract phase and into a paraffin-containing raffinate phase.

2. The process of claim 1 wherein the bottoms product obtained in step (b) is further separated into a decant oil portion and a slurry oil portion, and wherein said slurry oil portion is recycled to said first catalytic cracking zone, and wherein said decant oil portion is passed to said second fractionation zone.

3. The process of claim 1 wherein said bottoms product obtained in step (e) is recycled to said second catalytic cracking zone.

4. The process of claim 1 wherein at least a portion of said paraffin-containing raffinate phase obtained in step (f) is recycled to said second catalytic cracking zone.

5. The process of claim 1 wherein said first catalytic cracking step is conducted at a temperature in the range of 870°–960° F and a conversion level of about 30–60 percent, and said second catalytic cracking step is conducted at a temperature in the range of 905°–970° F and a conversion level in the range of 50–80 percent.

6. The process of claim 1 wherein all of said heavy cycle oil obtained in step (b) is passed to said second fractionation zone.

7. The process of claim 1 wherein a further portion of said heavy cycle oil obtained in step (b) is combined with said heavy cycle oil obtained in step (e) and the resulting combined stream is passed to said solvent extraction zone.

8. The process of claim 7 wherein the amount of said heavy cycle oil obtained in step (b) is not greater than 10 percent of said combined stream.

9. The process of claim 7 wherein the amount of said heavy cycle oil obtained in step (b) is not greater than about 7 percent of said combined stream.

* * * * *

UNITED STATES PATENT AND TRADEMARK OFFICE

CERTIFICATE OF CORRECTION

PATENT NO. : 4,111,791

DATED : September 5, 1978

INVENTOR(S) : Edgar D. Davis

It is certified that error appears in the above-identified patent and that said Letters Patent are hereby corrected as shown below:

Column 6, line 1, "crackign" should read --- cracking ---; and "efflent" should read --- effluent ---; line 5, --- zone --- should be inserted after "cracking".

Signed and Sealed this

*First* Day of *May 1979*

[SEAL]

*Attest:*

RUTH C. MASON
*Attesting Officer*

DONALD W. BANNER
*Commissioner of Patents and Trademarks*